US011070922B2

(12) United States Patent
Damsgaard et al.

(10) Patent No.: US 11,070,922 B2
(45) Date of Patent: Jul. 20, 2021

(54) METHOD OF OPERATING A HEARING AID SYSTEM AND A HEARING AID SYSTEM

(71) Applicant: Widex A/S, Lynge (DK)

(72) Inventors: Anne Vikaer Damsgaard, Ganlose (DK); Carsten Paludan-Muller, Frederikssund (DK)

(73) Assignee: Widex A/S, Lynge (DK)

( * ) Notice: Subject to any disclaimer, the term of this patent is extended or adjusted under 35 U.S.C. 154(b) by 61 days.

(21) Appl. No.: 16/458,603

(22) Filed: Jul. 1, 2019

(65) Prior Publication Data

US 2019/0327565 A1 Oct. 24, 2019

Related U.S. Application Data

(63) Continuation of application No. 15/435,509, filed on Feb. 17, 2017, now abandoned.

(30) Foreign Application Priority Data

Feb. 24, 2016 (DK) ..... PA201600110

(51) Int. Cl.
*H04R 25/00* (2006.01)

(52) U.S. Cl.
CPC ..... *H04R 25/356* (2013.01); *H04R 25/505* (2013.01); *H04R 25/70* (2013.01);
(Continued)

(58) Field of Classification Search
CPC .... H04R 25/356; H04R 25/505; H04R 25/70; H04R 2225/021; H04R 25/606; H04R 2225/025; H04R 2225/023; H04R 2225/43
See application file for complete search history.

(56) References Cited

U.S. PATENT DOCUMENTS 3,115,079 A 12/1963 Saffian
4,882,762 A 11/1989 Waldhauer
(Continued)

FOREIGN PATENT DOCUMENTS

WO 03/007654 A1 1/2003
WO 2005/051039 A1 6/2005
(Continued)

OTHER PUBLICATIONS

Eric D Young: Representation of Sound in the Auditory Nerve, Department of Biomedical Engineering, Johns Hopkins University, Sep. 5, 2012 (hereinafter Eric), (http://pages.jh.edu/~strucfunc/strucfunc/2012_files/2012_09_06.pdf; retrieved on Dec. 9, 2018).*
(Continued)

*Primary Examiner* — Oyesola C Ojo
(74) *Attorney, Agent, or Firm* — Sughrue Mion, PLLC

(57) ABSTRACT

A method (300) of operating a hearing aid system wherein the acoustical output signal intensity levels are confined to a range that primarily high-spontaneous rate auditory nerve fibres respond to, hereby providing sound processing that may benefit individuals with an auditory neurodegeneration, a computer-readable storage medium having computer-executable instructions, which when executed carries out the method, a hearing aid system (100, 200) adapted to carry out the method and a method of fitting a hearing aid system.

8 Claims, 3 Drawing Sheets

(52) U.S. Cl.
CPC ..... *H04R 25/606* (2013.01); *H04R 2225/021* (2013.01); *H04R 2225/023* (2013.01); *H04R 2225/025* (2013.01); *H04R 2225/43* (2013.01)

(56) References Cited

U.S. PATENT DOCUMENTS

| | | | | |
|---|---|---|---|---|
| 5,488,668 | A * | 1/1996 | Waldhauer | H03G 7/004 381/106 |
| 5,838,801 | A * | 11/1998 | Ishige | H04R 25/70 381/321 |
| 6,104,822 | A | 8/2000 | Melanson | |
| 6,275,596 | B1 * | 8/2001 | Fretz | H04R 25/656 381/321 |
| 7,457,757 | B1 * | 11/2008 | McNeill | G10L 21/0208 704/500 |
| 7,813,931 | B2 * | 10/2010 | Hetherington | G10L 21/02 704/500 |
| 8,098,859 | B2 * | 1/2012 | Zeng | H04R 25/353 381/316 |
| 9,392,378 | B2 * | 7/2016 | Jensen | H04R 25/356 |
| 9,409,015 | B2 * | 8/2016 | Harczos | A61N 1/36038 |
| 9,722,562 | B1 * | 8/2017 | Seguin | H03G 9/005 |
| 10,080,894 | B2 | 9/2018 | Richter | |
| 10,130,809 | B2 * | 11/2018 | Cartledge | H04R 1/1016 |
| 2003/0007657 | A1 * | 1/2003 | Ludvigsen | H04R 25/356 381/312 |
| 2009/0226015 | A1 | 9/2009 | Zeng et al. | |
| 2012/0302859 | A1 | 11/2012 | Keefe | |
| 2013/0266166 | A1 | 10/2013 | Dressler | |
| 2013/0287236 | A1 * | 10/2013 | Kates | H04R 25/356 381/312 |
| 2015/0264482 | A1 * | 9/2015 | Neely | H04R 1/10 381/320 |
| 2018/0332411 | A1 | 11/2018 | Francart | |

FOREIGN PATENT DOCUMENTS

| | | | |
|---|---|---|---|
| WO | 2007025569 | | 9/2005 |
| WO | 2010028683 | A1 | 3/2010 |
| WO | 2011/107175 | A1 | 9/2011 |
| WO | 2013029679 | A1 | 3/2013 |

OTHER PUBLICATIONS

International Search Report dated Apr. 4, 2017 in PCT/EP2017/052358.

Search Report of Danish Patent Application No. 2016 00110, dated May 19, 2016.

* cited by examiner

METHOD OF OPERATING A HEARING AID SYSTEM AND A HEARING AID SYSTEM

CROSS REFERENCE TO RELATED APPLICATIONS

This application claims priority based on Danish Patent Application No. PA201600110, filed Feb. 24, 2016, the contents of which are incorporated herein by reference in their entirety.

The present invention relates to hearing aid systems. The present invention also relates to a method of operating a hearing aid system and to a computer-readable storage medium having computer-executable instructions, which when executed carries out the method. The method also relates to a method of fitting a hearing aid system.

BACKGROUND OF THE INVENTION

Generally a hearing aid system according to the invention is understood as meaning any system which provides an output signal that can be perceived as an acoustic signal by a user or contributes to providing such an output signal, and which has means which are used to compensate for an individual hearing deficiency of the user or contribute to compensating for the hearing deficiency of the user or contribute to compensating for the hearing deficiency. These systems may comprise hearing aids which can be worn on the body or on the head, in particular on or in the ear, and can be fully or partially implanted. However, some devices, whose main aim is not to compensate for a hearing deficiency, may also be regarded as hearing aid systems, for example consumer electronic devices (televisions, hi-fi systems, mobile phones, MP3 players etc.) provided they have, however, measures for compensating for an individual hearing deficiency.

Within the present context a hearing aid may be understood as a small, battery-powered, microelectronic device designed to be worn behind or in the human ear by a hearing-impaired user.

Prior to use, the hearing aid is adjusted by a hearing aid fitter according to a prescription. The prescription is based on a hearing test, resulting in a so-called audiogram, of the performance of the hearing-impaired user's unaided hearing. The prescription may be developed to reach a setting where the hearing aid will alleviate a hearing deficiency by amplifying sound at frequencies in those parts of the audible frequency range where the user suffers a hearing deficit.

A hearing aid comprises one or more microphones, a battery, a microelectronic circuit comprising a signal processor, and an acoustic output transducer. The signal processor is preferably a digital signal processor. The hearing aid is enclosed in a casing suitable for fitting behind or in a human ear. For this type of traditional hearing aids the mechanical design has developed into a number of general categories. As the name suggests, Behind-The-Ear (BTE) hearing aids are worn behind the ear. To be more precise, an electronics unit comprising a housing containing the major electronics parts thereof is worn behind the ear and an earpiece for emitting sound to the hearing aid user is worn in the ear, e.g. in the concha or the ear canal. In a traditional BTE hearing aid, a sound tube is used to convey sound from the output transducer, which in hearing aid terminology is normally referred to as the receiver, located in the housing of the electronics unit, and to the ear canal. In some modern types of hearing aids a conducting member comprising electrical conductors conveys an electric signal from the housing and to a receiver placed in the earpiece in the ear. Such hearing aids are commonly referred to as Receiver-In-The-Ear (RITE) hearing aids. In a specific type of RITE hearing aids the receiver is placed inside the ear canal. This category is sometimes referred to as Receiver-In-Canal (RIC) hearing aids. In-The-Ear (ITE) hearing aids are designed for arrangement in the ear, normally in the funnel-shaped outer part of the ear canal. In a specific type of ITE hearing aids the hearing aid is placed substantially inside the ear canal. This category is sometimes referred to as Completely-In-Canal (CIC) hearing aids. This type of hearing aid requires an especially compact design in order to allow it to be arranged in the ear canal, while accommodating the components necessary for operation of the hearing aid.

Some hearing aid systems do not comprise a traditional loudspeaker as output transducer. Examples of hearing aid systems that do not comprise a traditional loudspeaker are cochlear implants, implantable middle ear hearing devices (IMEHD) and bone-anchored hearing aids (BAHA).

Within the present context a hearing aid system may comprise a single hearing aid (a so called monaural hearing aid system) or comprise two hearing aids, one for each ear of the hearing aid user (a so called binaural hearing aid system). Furthermore the hearing aid system may comprise an external device, such as a smart phone having software applications adapted to interact with other devices of the hearing aid system, or the external device alone may function as a hearing aid system. Thus within the present context the term "hearing aid system device" may denote a traditional hearing aid or an external device.

It is well known for persons skilled in the art of hearing aid systems that some hearing aid system users are not satisfied with results of conventional hearing-aid fitting that primarily is based on measuring an elevated hearing threshold.

A subgroup of potential hearing aid users is assumed to have auditory-nerve dysfunction due to aging or ototoxic drug exposure or noise trauma. This type of hearing deficit may also be denoted auditory neurodegeneration and may generally take on a variety of different forms including e.g. auditory neuropathy and auditory neuro-synaptopathy. Auditory neuro-synaptopathy is a dysfunction in the synapses that transmits hearing information from e.g. the inner hair cells of the cochlea and to nerve fibres that carry the hearing information further on to the processing parts of the brain. A plurality of synapses are required to be activated in order to provide that a nerve fibre is activated and transmits the hearing information.

This type of hearing dysfunction is not necessarily accompanied by an elevated hearing threshold, and the traditional hearing aid system processing techniques that are based on compensating an elevated hearing threshold are therefore generally not well suited for relieving a hearing deficit resulting from an auditory neurodegeneration.

It is therefore a feature of the present invention to suggest a method of operating a hearing aid system adapted to provide hearing-aid sound processing that can benefit individuals with an auditory neurodegeneration.

It is another feature of the present invention to suggest a hearing aid system adapted to carry out a sound processing method that can benefit individuals with a detected auditory neurodegeneration.

Yet another feature of the present invention is to suggest a method of fitting a hearing aid system in order to operate in accordance with the suggested method of operating a hearing aid system.

SUMMARY OF THE INVENTION

The invention, in a first aspect, provides a method of operating a hearing aid system comprising the steps of: providing an input signal representing an acoustical signal from an input transducer of the hearing aid system; providing the input signal to an auditory nerve compressor; selecting a minimum output level for the auditory nerve compressor, wherein the minimum output level represents a hearing threshold level; selecting a maximum output level for the auditory nerve compressor, wherein the maximum output level represents an upper end of a range of acoustical output signal intensity levels that primarily high-spontaneous rate auditory nerve fibres respond to or represents an upper end of a range of acoustical output signal intensity levels that primarily high-spontaneous rate and medium-spontaneous rate auditory nerve fibres respond to; defining a minimum input signal level and a maximum input signal level; operating the auditory nerve compressor according to a compression characteristic wherein the minimum input signal level is mapped onto the minimum output level of the auditory nerve compressor, and wherein the maximum input signal level is mapped onto the maximum output level of the auditory nerve compressor; and using an output signal derived from the auditory nerve compressor output signal to drive an electrical-acoustical output transducer of the hearing aid system.

The invention, in a second aspect, provides a computer-readable storage medium having computer-executable instructions thereon, which when executed by a computer perform the foregoing method.

The invention, in a third aspect, provides a hearing aid system comprising: an input transducer adapted to provide an input signal; an auditory nerve compressor configured to process the input signal and hereby provide an output signal, wherein the output signal from the auditory nerve compressor represents an acoustical output signal having intensity levels confined within a range that primarily high-spontaneous rate auditory nerve fibres respond to or confined within a range of acoustical output signal intensity levels that primarily high-spontaneous rate and medium-spontaneous rate auditory nerve fibres respond to, whereby the activity of low-spontaneous rate auditory nerve fibres is decreased relative to the activity of high-spontaneous rate and/or medium-spontaneous rate auditory nerve fibres when exposed to sound provided by the hearing aid system; and an output transducer adapted for providing an acoustical output signal based on the output signal from the auditory nerve compressor.

The invention, in a fourth aspect, provides a method of fitting a hearing aid system comprising the steps of: identifying an auditory neurodegeneration; configuring a hearing aid system compressor by: selecting a minimum output level that represents a hearing threshold level; selecting a maximum output level that represents either an upper end of a range of acoustical output signal intensity levels that primarily high-spontaneous rate auditory nerve fibres respond to in case an auditory neurodegeneration has been identified for both medium-spontaneous rate and low-spontaneous rate auditory nerve fibres, or that represents an upper end of a range of acoustical output signal intensity levels that primarily high-spontaneous rate and medium-spontaneous rate auditory nerve fibres respond to in case an auditory neurodegeneration has been identified only for low-spontaneous rate auditory nerve fibres; defining a minimum input signal level and a maximum input signal level; and wherein the compressor further comprises a compression characteristic wherein the minimum input signal level is mapped onto the minimum output level and wherein the maximum input signal level is mapped onto the maximum output level.

Further advantageous features appear from the dependent claims.

Still other features of the present invention will become apparent to those skilled in the art from the following description wherein the invention will be explained in greater detail.

BRIEF DESCRIPTION OF THE DRAWINGS

By way of example, there is shown and described a preferred embodiment of this invention. As will be realized, the invention is capable of other embodiments, and its several details are capable of modification in various, obvious aspects, all without departing from the invention. Accordingly, the drawings and descriptions will be regarded as illustrative in nature and not as restrictive. In the drawings.

DETAILED DESCRIPTION

Within the present context auditory nerve-fibres that primarily respond to low sound pressure levels are denoted high-spontaneous rate (HSR) nerve-fibres and are characterized in that they are robust. As opposed hereto the auditory nerve-fibres that respond to the medium and high sound pressure levels are typically more vulnerable to damage, and this will typically affect a person's ability to hear in noisy situations and generally in situations with a high sound pressure level, such as a cocktail party or a similar situation with many people talking simultaneously. These latter nerve-fibres are typically denoted respectively medium-spontaneous rate (MSR) nerve-fibres and low-spontaneous rate (LSR) nerve-fibres. Damaged MSR and/or LSR nerve-fibres will not necessarily affect the hearing threshold, although it is in no way impossible that a person can suffer from both an auditory neurodegeneration and an elevated hearing threshold.

For normal hearing persons the low sound pressure levels that the HSR nerve-fibres primarily respond to are in the range between say 0-40 dB SPL, the medium sound pressure levels that the MSR nerve-fibres primarily respond to are in the range between say 20-80 dB SPL, and the high sound pressure levels that the LSR nerve-fibres primarily respond to are in the range between say 40-120 dB SPL.

For persons suffering from a hearing deficit that results in an elevated hearing threshold the HSR nerve-fibres will primarily respond to sound pressure levels in the range between the hearing threshold (i.e. 0 dB SL) and 40 dB above the hearing threshold (i.e. 40 dB SL), the medium sound pressure levels that the MSR nerve-fibres primarily respond to are in the range between say 20-80 dB SL and the high sound pressure levels that the LSR nerve-fibres primarily respond to are in the range between say 40-120 dB SL. However, it is noted that for persons suffering from a more complex hearing deficiency, such as an outer hair cell loss, then the above ranges may be slightly different.

The MSR and LSR nerve-fibres that respond to the medium and high sound pressure levels are characterized in that they, as opposed to the HSR nerves-fibres that primarily respond to low sound pressure levels, comprise two different types of synapses, wherein a second synapse type that is generally not part of the HSR nerve-fibres differs from a first type in that the second synapse type is faster, but also less robust against damage from e.g. ototoxic drug use or excessive sound exposure. Thus the HSR nerve-fibres, which primarily comprises nerve-fibres of the first type, are therefore expected to be slower but also more robust than the MSR and LSR nerve-fibres.

Figure 1:
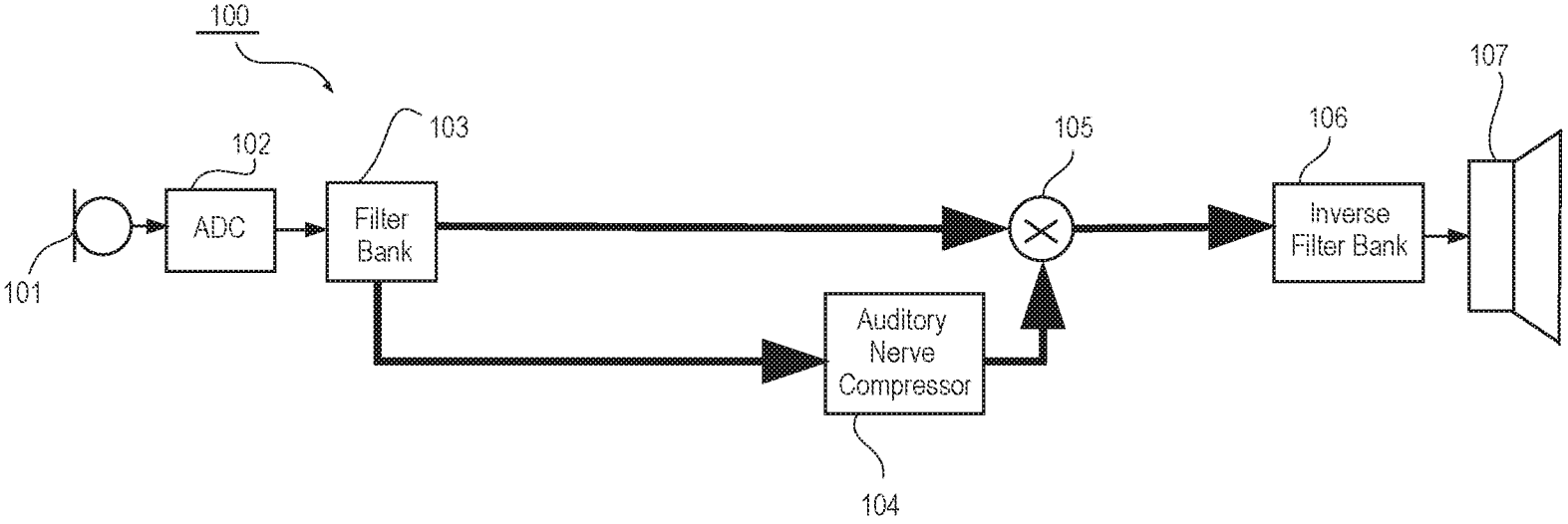
FIG. 1 illustrates highly schematically a hearing aid system according to a first embodiment of the invention.

Reference is first made to FIG. 1, which illustrates highly schematically a hearing aid system 100 according to a first embodiment of the invention. The hearing aid system 100 comprises an acoustical-electrical input transducer 101, and analog-digital converter (ADC) 102, a filter bank 103, an auditory nerve compressor 104, a first gain multiplier 105, an inverse filter bank 106, and an electrical-acoustical output transducer 107.

The acoustical-electrical input transducer 101 provides an analog input signal that is fed to the ADC 102 for conversion to the digital domain, and the digital input signal is subsequently provided to the filter bank 103. The filter bank 103 splits the input signal into a plurality of frequency band signals (that may also simply be denoted frequency bands) and provides these to both the auditory nerve compressor 104 and the first gain multiplier 105. In the figures the plurality of frequency bands are illustrated by bold lines.

According to the first embodiment the auditory nerve compressor 104 is adapted to relieve a hearing deficit of an individual hearing aid user by providing for each frequency band signal an appropriate gain as a function of a frequency band signal level that is determined by a signal level estimator (not shown in FIG. 1 for reasons of clarity). This general functionality is well known within the art of hearing aid systems and compressor is a well-known term for a component providing this type of functionality. Further details concerning implementation of hearing aid system compressors may be found in e.g. WO-A1-2007/025569 and WO-A1-2010/028683.

It is an advantageous aspect of the present invention that the auditory nerve compressor 104 is specifically adapted to compress the input signal such that the provided acoustical output signal primarily activates healthy auditory nerve-fibres. The frequency dependent gains determined by the auditory nerve compressor 104 are applied to the respective corresponding frequency band signals using the first gain multiplier 105 hereby providing processed frequency band signals that subsequently are combined in the inverse filter bank 106 to provide an electrical output signal that is converted into an acoustical signal by the electrical-acoustical output transducer 107.

According to the first embodiment the auditory nerve compressor 104 is adapted such that the provided output signal has a minimum signal level that corresponds to the hearing threshold (i.e. 0 dB SL), and such that the provided output signal has a maximum signal level, which is set to 40 dB SL or is selected from a range between 30 and 50 dB SL, which is expected to correspond to an upper level of the acoustical signal intensity levels that HSR nerve-fibres primarily respond to. According to the first embodiment a compression characteristic for the auditory nerve compressor 104 is therefore obtained based on a defined a minimum input signal level and a defined maximum input signal that are mapped onto respectively the minimum output level of the auditory nerve compressor 104 and onto the maximum output level of the auditory nerve compressor 104.

According to variations of the first embodiment the minimum input signal level is defined based on either the available dynamic range of the ADC or based on the noise floor of the input transducer. According to still further variations the maximum input signal level is defined based on the available dynamic range of the ADC for the lower range of the audible frequency spectrum and based on the output characteristics of the input transducer for the high frequency range of the audible frequency spectrum. However, it is not essential for the invention exactly how the minimum and maximum input signal levels are defined.

The exact number of frequency bands are not essential for the present invention. In fact, according to a variation of the present invention, the hearing aid system has only one frequency band. This solution may be advantageous with respect to simplicity of implementation and cost but generally a plurality of frequency bands are preferred. It is well known for a person skilled in the art of hearing aid systems that the number of available frequency bands, according to variations may vary between say 3 and up to say 1024.

According to one specifically advantageous variation the provided frequency bands correspond to the so called auditory critical bands provided by the cochlea (the critical auditory bands are also denoted the Bark bands). There are 24 auditory critical bands. It is expected that some types of auditory neurodegeneration are present only within one or a plurality of auditory critical bands while the remaining auditory critical bands are free from auditory neurodegeneration, and consequently improved performance of the present invention is not expected by increasing the number of frequency bands, unless the present invention is combined with some form of noise reduction, while decreased performance of the present invention is expected if decreasing the number of frequency bands below 24 or if distributing the 24 frequency bands shifted with respect to the Bark bands.

According to another variation the auditory nerve compressor 104 is adapted such that the provided output signal has a minimum signal level that corresponds to the hearing threshold (i.e. 0 dB SL), and adapted such that the provided output signal has a maximum signal level selected from a range between 50 and 80 dB SL which represents an upper end of a range of acoustical output signal intensity levels that primarily HSR and MSR auditory nerve fibres respond to.

Figure 2:
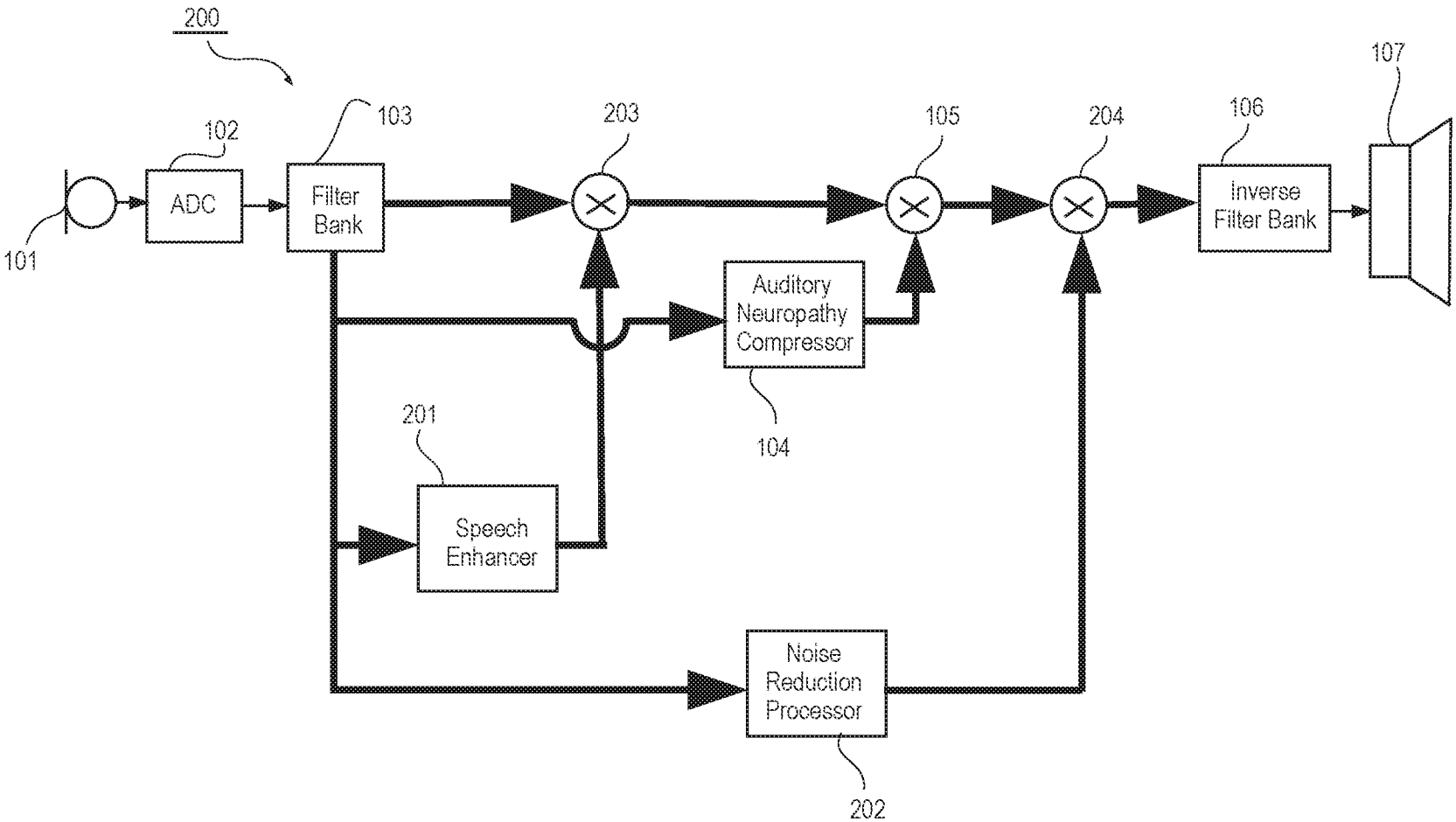
FIG. 2 illustrates highly schematically a hearing aid system according to a second embodiment of the invention.

Reference is now made to FIG. 2, which illustrates highly schematically a hearing aid system 200 according to a second embodiment of the invention. The hearing aid system 200 comprises all the components of FIG. 1 (and the numbering for these components are therefore maintained), and in addition hereto a speech enhancer 201, a noise reduction processor 202, a second gain multiplier 203, and a third gain multiplier 204.

The gains determined by the auditory nerve compressor 104, the speech enhancer 201 and the noise reduction processor 202 are applied to the frequency bands provided by the filter bank 103 by the gain multipliers 105, 203 and 204 respectively hereby providing processed frequency bands that are combined in the inverse filter bank 106, wherefrom an output signal is provided to the electrical-acoustical output transducer 107.

According to the present embodiment the noise reduction processor 202 is configured such that only negative frequency dependent noise suppressing gain values are determined. The negative noise suppression gain values are advantageous because they can be applied by the third gain multiplier 204 that is positioned downstream of the first gain multiplier 105 without the risk of providing output signal levels above the level that the intended auditory nerve-fibres primarily respond to. The speech enhancer 201, on the other hand, is typically implemented to determine both positive and negative frequency dependent speech enhancing gains and as a consequence hereof these gains are applied by the second gain multiplier 203 that is positioned upstream of the first gain multiplier 105.

According to variations of the FIG. 2 embodiment the speech enhancer 201 and the noise reduction processor 202 may benefit from more aggressive noise reduction algorithms or alternative processing schemes (which may also be denoted hearing aid features) directed at relieving the amount of sound that the auditory nerves are exposed to. Examples of such alternative hearing aid features comprise frequency contrast enhancement and interleaved frequency band processing.

The method of frequency contrast enhancement in a hearing aid system may be described by the steps of:

- providing an electrical input signal representing an acoustical signal from an input transducer of the hearing aid system;
- splitting the input signal into a first plurality of frequency bands;
- determining a measure of the signal variability for each band of a second plurality of frequency bands;
- determining a threshold level based on the determined measures of the signal variability for each band of the second plurality of frequency bands;
- applying a first gain to a frequency band based on an evaluation of the determined measure of the signal variability for said frequency band relative to the threshold level;
- combining the first plurality of frequency bands into an electrical output signal; and
- using the electrical output signal for driving an output transducer of the hearing aid system.

The method of interleaved frequency band processing in a hearing aid system may be described by the steps of:

- providing an electrical input signal representing an acoustical signal from an input transducer of the hearing aid system;
- splitting the input signal into a plurality of frequency bands;
- forming a first group of frequency bands and a second group of frequency bands, wherein the first group of frequency bands comprises frequency bands that are interleaved with respect to frequency bands comprised in the second group of frequency bands;
- alternating between selecting the first group of frequency bands or the second group of frequency bands;
- processing the selected frequency bands in a first manner, hereby providing processed selected frequency bands;
- processing the non-selected frequency bands in a second manner such that the non-selected frequency bands are attenuated relative to the selected frequency bands, hereby providing processed non-selected frequency bands;
- providing an output signal based on the processed selected and non-selected frequency bands; and
- using the output signal to drive an output transducer of the hearing aid system.

Figure 3:
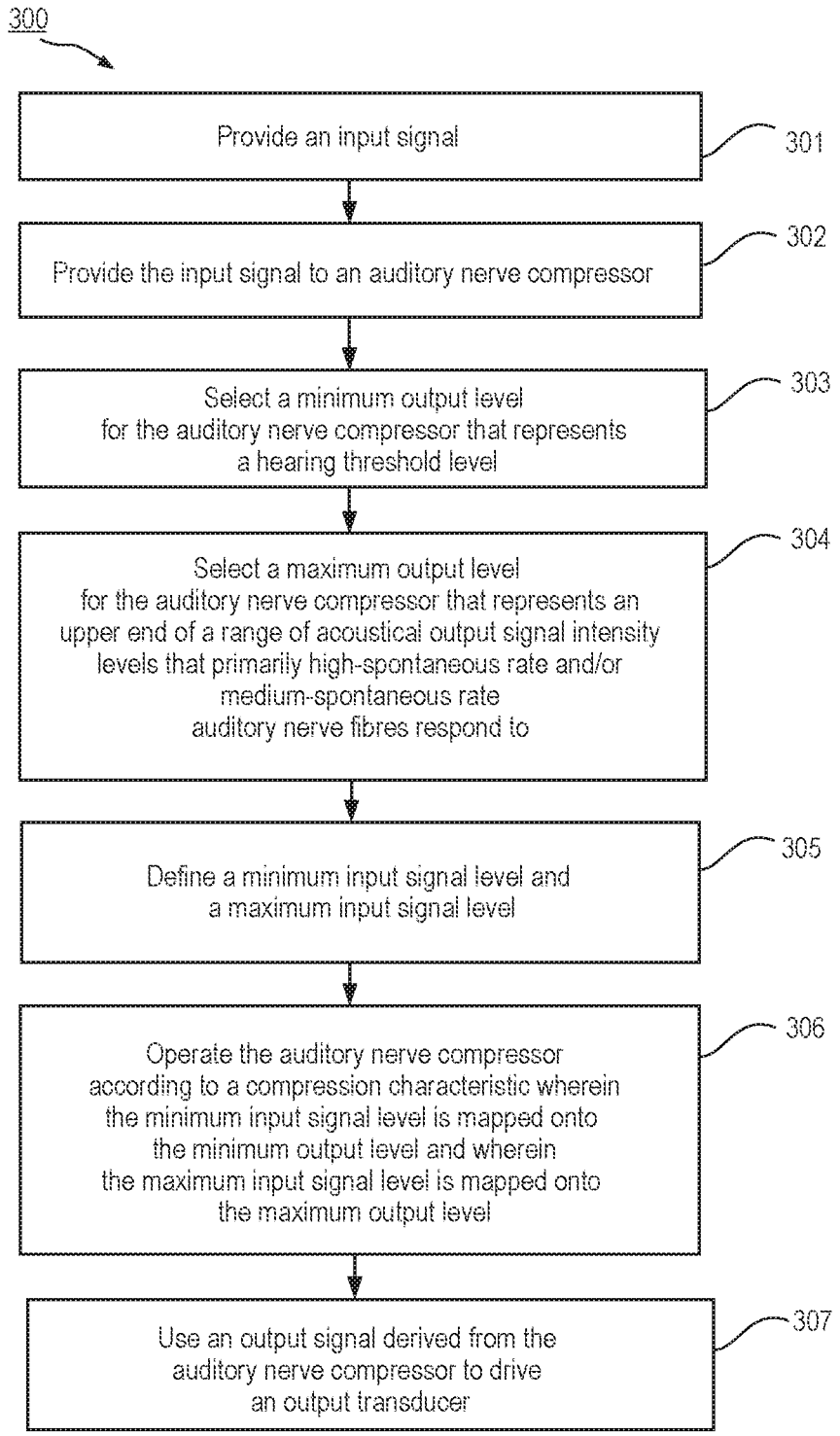
FIG. 3 illustrates highly schematically a method of operating a hearing aid system according to an embodiment of the invention.

Reference is now given to FIG. 3, which illustrates highly schematically a flow chart of a method 300 of operating a hearing aid system according to an embodiment of the invention. The method comprises

- a first step 301 of providing an input signal representing an acoustical signal from an input transducer of the hearing aid system;
- a second step 302 of providing the input signal to an auditory nerve compressor;
- a third step 303 of selecting a minimum output level for the auditory nerve compressor, wherein the minimum output level represents a hearing threshold level;
- a fourth step 304 of selecting a maximum output level for the auditory nerve compressor, wherein the maximum output level represents an upper end of a range of acoustical output signal intensity levels that primarily high-spontaneous rate auditory nerve fibres respond to or represents an upper end of a range of acoustical output signal intensity levels that primarily high-spontaneous rate and medium-spontaneous rate auditory nerve fibres respond to;
- a fifth step 305 of defining a minimum input signal level and a maximum input signal level;
- a sixth step 306 of operating the auditory nerve compressor according to a compression characteristic wherein the minimum input signal level is mapped onto the minimum output level of the auditory nerve compressor, and wherein the maximum input signal level is mapped onto the maximum output level of the auditory nerve compressor; and
- a seventh step 307 of using an output signal derived from the auditory nerve compressor output signal to drive an electrical-acoustical output transducer of the hearing aid system.

In variations of the disclosed embodiments the maximum output level for the auditory nerve compressor represents an upper end of a range of acoustical output signal intensity levels that primarily high-spontaneous rate and medium-spontaneous rate auditory nerve fibres respond to. This variation is advantageous in case only the LSR auditory nerve fibres have been damaged and probably most advantageous for hearing aid system users that do not suffer from an elevated threshold hearing deficit.

In another variation the compression characteristic of the auditory nerve compressor comprises a knee point dividing the compression characteristic into a first part comprising the lower signal levels and a second part comprising the higher signal levels and wherein the compression ratio is larger in the second part than in the first part. However according to further variations, other more or less complex compression characteristics may be applied.

In a further variation the input transducer is not of the acoustical-electrical type. Instead the input transducer is a wireless transceiver, whereby the inventive concepts of the present invention may also be applied in connection with e.g. digital audio streamed from a television or some other source of streamed audio.

According to yet another aspect of the present invention a method of fitting a hearing aid system is disclosed, wherein the hearing aid system is adapted to operate in accordance with the disclosed embodiments based on a previous test of whether the individual hearing aid system user suffers from an auditory neurodegeneration that only is present in some auditory nerve fibre types or only in some frequency bands.

One such method, that may be carried out in a plurality of different frequency bands, comprises the steps of:

- providing a first test sound at a first intensity level;
- amplitude modulating the first test sound or adding a second test sound with a second intensity level;
- prompting a person to identify an intensity level difference based on the amplitude modulation of the first test sound or based on a comparison of the intensity level of the first and second test sound respectively;

receiving an input from the person in response to said prompting;

determining the person's ability to perceive small differences in intensity level based on the input from the person; and identifying an auditory neurodegeneration for the person if the ability to perceive small differences in intensity level is reduced compared to the ability of normal hearing persons.

Another such method, that may also be carried out in a plurality of different frequency bands, comprises the steps of:

providing a first test sound having a first intensity level and a first duration;

providing a second test sound, having a second intensity level and a third duration;

providing a period of silence, in between said first and second test sounds, wherein the period of silence has a second duration;

prompting a person to detect the second test sound;

receiving an input from the person in response to said prompting;

determining the person's sensitivity to temporal masking based on the input from the person;

identifying an auditory neuro-synaptopathy for the person if the sensitivity to temporal masking is increased compared to normal hearing persons.

According to still another variation the range of acoustical output signal intensity levels is selected based on the individual user's preferences or the individual user's performance in speech intelligibility tests as a function of the range of acoustical output signal intensity levels. Hereby an optimum setting can be found as a compromise between the desire to avoid activating defect auditory fibres and the desire to provide an acoustical output signal level with a dynamic range that is not too limited.

Generally the disclosed embodiments and their variations may be implemented based on a computer-readable storage medium having computer-executable instructions, which when executed carry out the disclosed methods.

Generally any of the disclosed embodiments of the invention may be varied by including one or more of the variations disclosed above with reference to another of the disclosed embodiments of the invention. Thus the disclosed method embodiment may also be varied by including one or more of the hearing aid system variations.

The invention claimed is:

1. A method of operating a hearing aid system used by a hearing aid user, comprising the steps of:

providing an input signal representing an acoustical signal from an input transducer of the hearing aid system;

providing the input signal to an auditory nerve compressor;

selecting a minimum output level for the auditory nerve compressor, wherein the minimum output level represents a hearing threshold level;

selecting a maximum output level for the auditory nerve compressor:

from a range between 30 and 50 dB SL if an auditory neurodegeneration has been identified in said hearing aid user for both medium-spontaneous rate and low-spontaneous rate auditory nerve fibers; or from a range between 50 and 80 dB SL if an auditory neurodegeneration has been identified in said hearing aid user only for low-spontaneous rate auditory nerve fibers, defining a minimum input signal level and a maximum input signal level;

operating the auditory nerve compressor according to a compression characteristic wherein the minimum input signal level is mapped onto the minimum output level of the auditory nerve compressor, and wherein the maximum input signal level is mapped onto the maximum output level of the auditory nerve compressor; and using an output signal derived from the auditory nerve compressor output signal to drive an electrical-acoustical output transducer of the hearing aid system.

2. The method according to claim 1 comprising the further steps of: splitting the input signal into a plurality of frequency bands; operating the auditory nerve compressor individually for said plurality of frequency bands; and combining the plurality of frequency bands that have been processed by the auditory nerve compressor.

3. The method according to claim 1 wherein the compression characteristic comprises a knee point dividing the compression characteristic into a first part comprising the lower signal levels and a second part comprising the higher signal levels and wherein the compression ratio is larger in the second part than in the first part.

4. The method according to claim 1, comprising the further steps of:

processing the input signal or a frequency band signal with a noise reduction algorithm and/or with a speech enhancement algorithm and/or with at least one algorithm specifically directed at relieving an auditory neurodegeneration and hereby determining at least one gain to be applied to the input signal or at least one frequency band signal;

applying the determined gain to the input signal or at least one frequency band signal.

5. A non-transitory computer-readable medium storing instructions thereon, which when executed by a computer perform the method according to claim 1.

6. A hearing aid system comprising:

an input transducer adapted to provide an input signal;

an auditory nerve compressor configured to process the input signal and hereby provide an output signal, wherein the output signal from the auditory nerve compressor represents an acoustical output signal having intensity levels confined within a range beginning at 0 dB SL and extending up to between 30 and 50 dB SL if an auditory neurodegeneration has been identified for both medium-spontaneous rate and low-spontaneous rate auditory nerve fibers, or confined within a range of acoustical output intensity levels beginning at 0 dB SL and extending up to between 50 and 80 dB SL if an auditory neurodegeneration has been identified only for low-spontaneous rate auditory nerve fibers, whereby the activity of low-spontaneous rate auditory nerve fibers is decreased relative to the activity of high-spontaneous rate and/or medium-spontaneous rate auditory nerve fibers when exposed to sound provided by the hearing aid system; and an output transducer adapted for providing an acoustical output signal based on the output signal from the auditory nerve compressor.

7. The hearing aid system according to claim 6 further comprising at least one of a first digital signal processor adapted to provide noise reduction, a second digital signal processor adapted to enhance speech, and a third digital signal processor adapted to specifically relieve an auditory neurodegeneration.

8. A method of fitting a hearing aid system comprising the steps of:

identifying an auditory neurodegeneration;

configuring a hearing aid system compressor by:

selecting a minimum output level that represents a hearing threshold level;

selecting a maximum output level from a range between 30 and 50 dB SL in case an auditory neurodegeneration has been identified for both medium-spontaneous rate and low-spontaneous rate auditory nerve fibers;

selecting a maximum output level from a range between 50 and 80 dB SL in case an auditory neurodegeneration has been identified only for low-spontaneous rate auditory nerve fibers; and defining a minimum input signal level and a maximum input signal level; and wherein the compressor further comprises a compression characteristic wherein the minimum input signal level is mapped onto the minimum output level and wherein the maximum input signal level is mapped onto the maximum output level.

* * * * *